US007959022B2

(12) United States Patent
Kerman et al.

(10) Patent No.: US 7,959,022 B2
(45) Date of Patent: Jun. 14, 2011

(54) CONTAINER WITH A POLYGONAL NECK

(75) Inventors: Eric Kerman, Chalons en Champagne (FR); Herve Zakrzewski, Verdun (FR)

(73) Assignee: Cebal S.A.S., Sainte Menehould (FR)

( * ) Notice: Subject to any disclaimer, the term of this patent is extended or adjusted under 35 U.S.C. 154(b) by 375 days.

(21) Appl. No.: 11/914,699

(22) PCT Filed: May 22, 2006 (Under 37 CFR 1.47)

(86) PCT No.: PCT/FR2006/001162
§ 371 (c)(1), (2), (4) Date: Mar. 24, 2008

(87) PCT Pub. No.: WO2006/128992
PCT Pub. Date: Dec. 7, 2006

(65) Prior Publication Data

US 2008/0230505 A1 Sep. 25, 2008

(30) Foreign Application Priority Data

May 30, 2005 (FR) ..... 05 05450

(51) Int. Cl.
*B65D 41/04* (2006.01)

(52) U.S. Cl. ..... 215/44; 215/43; 215/40; 215/252; 215/329; 220/288

(58) Field of Classification Search ..... 215/44, 215/43, 40, 329; 220/296, 288; D9/566, D9/561, 560, 559, 452, 435
See application file for complete search history.

(56) References Cited

U.S. PATENT DOCUMENTS

| | | | | |
|---|---|---|---|---|
| 3,581,926 | A | 6/1971 | Roder | |
| 4,373,641 | A * | 2/1983 | Banich et al. | 215/331 |
| 4,643,330 | A * | 2/1987 | Kennedy | 220/288 |
| 4,832,220 | A | 5/1989 | Quennessen | |
| 5,533,633 | A * | 7/1996 | King | 215/252 |
| 5,803,287 | A * | 9/1998 | Kusz | 215/330 |
| 5,992,656 | A * | 11/1999 | Dujardin et al. | 215/44 |
| 6,015,054 | A * | 1/2000 | King et al. | 215/252 |
| 6,105,802 | A * | 8/2000 | French et al. | 215/318 |
| 6,695,160 | B1 * | 2/2004 | Culley et al. | 215/329 |
| D541,671 | S * | 5/2007 | Stick et al. | D9/744 |
| D548,095 | S * | 8/2007 | McGuinness | D9/529 |
| D549,587 | S * | 8/2007 | Lestelle | D9/560 |
| D554,779 | S * | 11/2007 | Derges | D26/9 |

FOREIGN PATENT DOCUMENTS

| | | |
|---|---|---|
| DE | 9 317231 | 2/1994 |
| JP | 10 129696 | 5/1998 |

* cited by examiner

*Primary Examiner* — Anthony Stashick
*Assistant Examiner* — Cynthia F Collado
(74) *Attorney, Agent, or Firm* — Dennison, Schultz & MacDonald

(57) ABSTRACT

A container, such as a flask or a flexible tube, provided with a cap, the container including a side wall and a plastic head with a neck and a shoulder linking the neck to the side wall. The cap is provided with a circular cylindrical skirt on its inner surface with one or more first screwing means. The wall of the neck is substantially shaped like a prism where the cross-section is globally a polygon having a symmetry of order n about an axis A substantially parallel to the generatrix of the prism, n being an integer strictly greater than 1, and the neck is provided on its outer surface with n second screwing means, uniformly distributed about the axis A. The assembly of n second screwing means of the neck co-operates with the first screwing means of the cap.

20 Claims, 3 Drawing Sheets

CONTAINER WITH A POLYGONAL NECK

FIELD OF THE INVENTION

The invention relates to the field of plastic containers that dispense liquid or viscous substances, typically creams or pastes, in particular bottles and flexible tubes used to condition cosmetic products or body-care products.

DESCRIPTION OF RELATED ART

Cosmetic containers that dispense creams or other body-care products generally include a dispensing head provided with a collar or neck surrounding a dispensing opening, a container body and a shoulder connecting the neck to said body. They are often circular or elliptical in shape. The expression "circular shape" indicates, both for bottles and for flexible tubes before the transverse end weld has been made, that the body of the container has a cylindrical side wall whose section is a circle. When flexible tubes are filled and sealed by a transverse end welding, the part which forms the junction between the skirt and the edge of the shoulder always has rotational symmetry around the axis of said tube. In order to treat all containers concerned with the invention in the same way, in the following we will speak of the shape of the container by referring to the shape of the peripheral end of the shoulder to which the side wall of the container body or the flexible skirt of the tube is attached. This is in general circular or elliptical.

These containers are provided with a cap which comprises a bottom which, in closed position, surmounts the top wall (the mouth) of the neck, and to which a fastening skirt is attached which is slid around the neck, said neck and said fastening skirt being provided with further means of reversible fastening, typically screw threads and grooves or clip-fit ring-shaped ribs and grooves. The fastening skirt and the neck of the container, whether this is a bottle or a flexible tube and whether it is circular or elliptical, remain circular.

However, primarily for esthetic reasons, such containers can be of other shapes, for example shapes that are globally polygonal: triangular, square, pentagonal, hexagonal, etc Here again, the characteristic shape of the container is that of the section of the side wall of the bottle or that of the peripheral end of the tube shoulder. It is said to be globally polygonal because the angles of the polygon can be rounded by fillets, or the faces which separate the angles can be more or less hollow or convex, their curve radius being significantly higher that of any fillets. Also for esthetic reasons, the cap often has an outer wall the shape of which is adapted to that of the container. For example, by "extension" of the side wall of the bottle or the tube skirt, the side wall of the cap also has a globally polygonal shape. But although the shape of the side walls of the container and the cap may follow any globally polygonal contour, the neck of the container and the cap fastening skirt remain in almost all cases cylindrical, with circular sections, to make it easier to screw said cap onto the neck of said container.

Patent application FR 2.790.453 presents a pot with a non-circular collar—or neck—and a cap. The special system of fixing the closure system onto the neck notably includes lugs placed on the outer wall of the cap which work, after the manner of the fitting commonly known as a "bayonet" fitting, in conjunction with a ring with a noncircular contour formed close to the top wall of the collar and which extends radially towards the outside. The design of a non-cylindrical collar, in particular a collar with a section that is homothetic of that of the side wall of the container, while being motivated by esthetic reasons, also answers an engineering problem.

For pots, as indicated in FR 2.790.453, the presence of a circular collar and a noncircular side wall, pose a problem of accessibility of the consumer's fingers to that part of the product which is in particular located in the inside corners of the pot. With bottles and tubes, the dispensing opening is in general too small for the finger to directly access the product in the container. The problem of accessing the product therefore does not arise but the association of a polygonal wall with a circular neck results in a lowering of the restitution rate of the product which gets worse as the number of angles of the polygon decreases. This is because, as the distance between the edge of the circular opening and the peripheral end of the shoulder is greater in the "angular" zones, there is an increase in the extent of the dead zone, i.e. the zone in which the product does not run out or runs out very slowly, while whirling round itself, despite the pressure exerted by the user on the skirt. The angular parts of the wall, which define a relatively large volume occupied by the product as compared with the rest of the tube, are also the stiffest parts of the wall, so that even if a lot of force is applied to these angular zones, in particular near the shoulder, one has a great deal of difficulty to extract the product occupying said dead zones.

The bayonet device in FR 2.790.453 undoubtedly has great advantages for closing pots but it appears to be less advantageous for tubes and bottles, primarily because of the way in which these are mass-produced. A tube blank is produced by molding the tube head—which includes the neck and the shoulder—and by fixing this, typically by welding, onto one of the open ends of the skirt. In order to be able to fill the product through the other open end of the skirt, the dispensing opening must first be sealed, typically while fixing the cap onto the tube head, at the end of the production line of the tube (an operation known as "capping") The most suitable kinematics for this operation is screwing: the tube blank is fixed to a mobile mandrel which is placed opposite a cap provided with a screw thread. One of the two is set rotating, while the other, prevented from rotating, is subjected to an axial translation towards the first: as a result, the cap is completely screwed onto the tube head.

Kinematics for container stoppers and heads with complementary means of fixing, of the "bayonet" type, can also be defined but they prove more problematic to regulate insofar as the rotation and translation movements cannot be constant nor independent of each other. For example, the axial translation movement must be made in two stages by bringing into play different forces: a first stage where the lugs are brought up against the ring while the latter turns around the axis of the neck, and a second stage when the lugs, which have arrived at a precise angular position of said ring, suddenly undergo an axial depression which makes them pass under said ring which continues to rotate. With such kinematics, the forces used are such that the slightest maladjustment can lead to much breakage and scrapping.

In patent application JP 10 129696, the aim is to form, on a single screw thread, radially low, regularly distributed protuberances which can act as brake, and to prevent unscrewing. These anti-unscrewing devices, instead of being relegated to the end of the thread, as they usually are, are here regularly distributed over the whole circumference and the whole height of the neck, the aim being to compensate for their low radial height by their number and their regular distribution. The advantage of such brakes is to provide better anti-unscrewing control, independently of inevitable manufacturing dimensional variations. The geometrical configuration of these brakes gives a prismatic neck whose base can be a regular octagon, decagon or a dodecagon.

The applicant has sought to develop containers, such as flexible bottles or tubes, provided with noncircular necks, which have a high restitution rate of the product to be dispensed and which are easy to cap under conditions of mass production.

SUMMARY OF THE INVENTION

A first subject according to the invention is a container, such as a bottle or a flexible tube, provided with a cap, said container comprising a side wall and a plastic head with a neck and a shoulder connecting said neck to said side wall, said cap being provided with a circular cylindrical skirt provided on its inner surface with one or more screwing means, wherein the wall of said neck has a substantially prismatic shape whose section is globally a polygon which has n-order symmetry around an axis A, substantially parallel with the generating line of said prism (the prism is superimposed on itself by a rotation of $2\pi/n$ around said axis A), n being an integer strictly greater than 1; and in that said neck is provided on its outer surface with n second screwing means, regularly distributed around said axis A, all the n second screwing means on the neck cooperating with the first screwing means on the cap.

According to the invention, the neck is substantially a prism, of globally polygonal section. The expression "substantially a prism" means that its walls are substantially parallel, i.e. parallel or very slightly tilted, by a few degrees at the most (typically less than 15°), in relation to a given direction which corresponds to that of the axis A of the n-order symmetry of the neck. This expression also means that the tops of the polygon can be rounded by means of fillets. In addition, the polygonal sections may contain curvilinear segments: their sides may have a certain curve directed towards the inside or the outside; if they have n-order symmetry around axis A, they may appear as a polygon with n sides, with n summits on the circumscribed circle, or in the shape of a polygon with kn sides (where k is an integer strictly higher than 1) with jn summits (where j is an integer between 1 and k inclusive) if j is other than 1, n summits will arbitrarily be chosen, regularly distributed or, preferably, the n edges regularly distributed closest to said circumscribed circle, that we will refer to in the following as "short peripheral edges". It is at the level of these summits or these edges that the n second screwing means are to be found. The n second screwing means are associated with n planes referred to as "axial planes": each second screwing means extends on either side of a plane (referred to as the axial plan) which passes through axis A and one of the n summits located on the circumscribed circle, or which passes through axis A and which is perpendicular to one of the n short peripheral edges.

Advantageously, the set of the n second screwing means has a n-order symmetry around axis A. In this way, the capsule remains properly guided and centered on the axis of the neck during screwing.

The invention is of particular value for cases in which order n of the axis symmetry is low, typically lower than 7, preferably lower than 5, where the neck can be of a clearly original shape, removed from the conventional cylindrical shape.

Preferably, the polygon is regular and globally convex. Preferably also, its angles are rounded. Concave shapes, star shapes and sharp angles are not to be recommended because they encourage the presence of corners which are a cause of the product's being held back. Insofar as sharp angles are avoided, the term "prism" used is in theory less suitable than the term "cylinder", but it was used in preference to the latter, which is too often associated exclusively with the conventional shape of a cylinder having a circular orthogonal (or elliptical) section. In the following, summits, even rounded ones, of the polygon are associated with the dihedra of the prism. In absence of sharp angles and plane faces, the term "dihedron" indicates the tangent dihedron, associating the planes of tangency defined in the connections of the fillets. In the geometrical configuration of the regular convex polygon, the axial plane associated with the second screwing means is a bisecting plane of one of the n dihedra of the prism.

According to the invention, the neck is provided on its outer surface with a screwing means which extends on either side, typically over a few millimeters, of the axial plane (i.e. of the plane which passes through axis A and through one of n summits located on the circumscribed circle, or which passes through axis A and is perpendicular to one of the n short peripheral edges). This screwing means is here referred to as the second screwing means, because the first screwing means is on the cap. It typically appears as a rib or groove. All these second means taken together form a discontinuous rib (or a discontinuous groove) or several ribs (or several grooves) cooperating with one or more grooves (or one or more ribs) of the cap.

For example, the first screwing means is/are one or more helical threads and each second screwing means is a groove of which the internal part, in particular around said axial plane, is comparable to a helical groove, which is supported by a helix of axis A, all the grooves together constituting a discontinuous groove or several grooves cooperating with the threads of the cap.

But preferably, the first screwing means is/are one or more helical threads and each second screwing means is a rib of which the peripheral part, in particular around said axial plane, is comparable to a helical thread, all the n ribs together constituting a discontinuous thread or several threads cooperating with the grooves of the cap.

Each rib preferably extends circumferentially only slightly on either side of the dihedron with which it is associated and has a variable radial height, which reaches maximum around the previously-defined axial plane, i.e. the plane which passes through axis A and which passes through one of n summits located on the circumscribed circle or which is perpendicular to one of the n short peripheral edges. The base of the rib is on the prismatic surface of the neck. It is preferably sufficiently limited circumferentially for said screwing rib not to weigh down the whole of the head, and sufficiently wide on either side of the axial plane for the variation in radial height of the rib between its ends and the related axial plane to be low: typically the radial height increases at the most by 30 hundredths of a millimeter per "circumferential" millimeter traveled. This makes it possible to limit the mechanical loads generated on said thread while the cap is being screwed. The base of the rib, in relation to axis A of the prism, has a slope identical to that of the helix on which the screwing groove of the cap associated with it bears. Preferably, each rib has a radial height equal to (or very close to) said maximum radial height over a certain circumferential length, typically at least a millimeter, and preferably a few millimeters on either side of said axial plane.

In other words, the second screwing means may be either a rib with variable height, resembling, at least in the vicinity of the axial plane, a helical thread, or a groove with variable depth, resembling, at least in the vicinity of the axial plane, a helical groove.

The neck has substantially the shape of a prism which has n-order symmetry around its axis, n being an integer strictly higher than 1. Preferably, said second screwing means also respect this n-order symmetry: each second screwing means has the same slope and, around each axial plane, an identical radial maximum height (or depth). All the n second screwing means associated with the n axial planes are regularly distributed around the axis of symmetry of the neck. Each of these second screwing means is a rib or a groove which acts, at least in its median part where it is near the axial plane and where its radial height (or depth) is at a maximum, as a complementary screwing means to the first screwing means of the cap which is associated with it.

The choice may be made of providing the fastening skirt of the cap with a single helical screwing groove. In this case, the ribs will be placed on the neck so that two consecutive ribs (in the direction of screwing, for example) are offset axially by p/n, p being the pitch of the helix on which the screwing groove bears. In this way, the n ribs form a discontinuous helical screwing thread cooperating with the helical screwing groove of the cap and, although in such a configuration the ribs do not respect the n-order symmetry, the cap continues to be properly guided and centered on the axis of the neck during said screwing. This latter operation typically requires one full rotation or more of the cap around the neck. In the same way, the choice may be made of providing the fastening skirt of the cap with a single helical screwing thread. In this case, the grooves are placed on the neck so that two consecutive grooves are axially offset by p/n. Here also, although these grooves do not respect the n-order symmetry, the cap continues to be properly guided and centered on the axis of the neck during screwing.

But, preferably, the fastening skirt is provided with n identical and regularly distributed quick-screw grooves (high helical pitch). In this case, each of the n ribs, regularly distributed around axis A, has the same slope, the same radial height and the same axial position (they thereby respect the n-order symmetry) and the cap can be closed in less than one nth of a turn. In the same way, the choice may be made of providing the fastening skirt of the cap with n helical quick-screw threads. In this case, the n grooves laid out regularly on the neck have n-order symmetry.

In a preferred method of the invention, the container head and the capsule are provided with anti-unscrewing devices.

The invention relates to any container having a prismatic neck with a substantially polygonal section. It relates specifically to containers which themselves have a substantially polygonal shape, i.e. with a peripheral part of the shoulder—directly connected to the side wall of the body of the bottle or to the skirt of the tube—that has a contour of substantially polygonal shape. Advantageously, containers whose substantially polygonal neck is homothetic of said contour of the peripheral part of the shoulder provide a high product restitution rate.

The invention relates in particular to containers provided with a closure, whose external side wall is also substantially prismatic polygonal with a shape adapted to that of the wall of the container body, for example deduced by construction of a prism starting from the polygonal contour of the peripheral part of the shoulder.

Another subject of the invention is the head of a container such as a bottle or a flexible tube, provided with a neck and a shoulder designed to connect said neck to the side wall of said container, wherein the wall of said neck has substantially the shape of a prism whose section is substantially a polygon with n-order symmetry around an axis A substantially parallel to the generating line of said prism, n being an integer strictly greater than 1, and in that said neck is provided on its outer surface with n screwing means, regularly distributed around said axis A.

All the n second screwing means advantageously have n-order symmetry around axis A. In this way, the cap designed to close said container head remains properly guided and centered on the axis of the neck during screwing onto said neck.

As indicated above, the polygon has n summits which are on the circumscribed circle of the polygon or n short peripheral edges which are near the circumscribed circle. It is at the level of these summits or these short peripheral edges that the n second screwing means are to be found: each second screwing means extends on either side of an axial plane which passes through axis A and one of the n summits located on the circumscribed circle, or which passes through axis A and which is perpendicular to one of the n short peripheral edges.

Preferably, each one of these screwing means takes the form of a discontinuous rib (a discontinuous groove) or several ribs (several grooves) of which the peripheral part (the interior part), in particular close to the axial planes, is comparable to one or more helical threads (one or more helical grooves).

Preferably, these are screwing ribs which have an identical maximum radial height in the region of each axial plane. All of the corresponding n ribs are regularly distributed around axis A with n-order symmetry of the neck, and each rib acts, at least in its mid part—which is in the axial plane and at the level of which the rib has maximum radial height—, like a helical screwing thread able to work in tandem with the helical screwing groove of a closure. Preferably, each rib has a radial height equal to (or very close to) said maximum radial height over a certain circumferential length, typically at least a millimeter on either side of the bisecting plane of the diedron.

DESCRIPTION OF PREFERRED EMBODIMENTS

Example 1

FIGS. 1*a*, 1*b*, 2 and 3

Figure 1A:
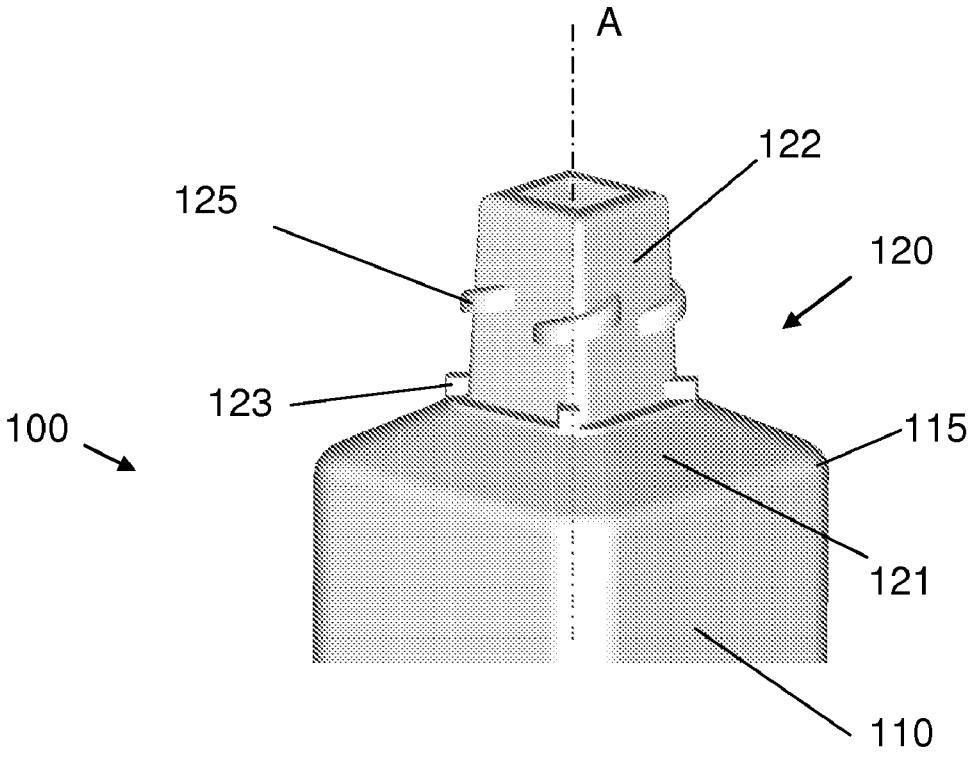
FIG. 1*a* illustrates, as an axonometric projection, the head of a container according to the invention, without its closure: it has a substantially square neck, with rounded angles.
Figure 1B:
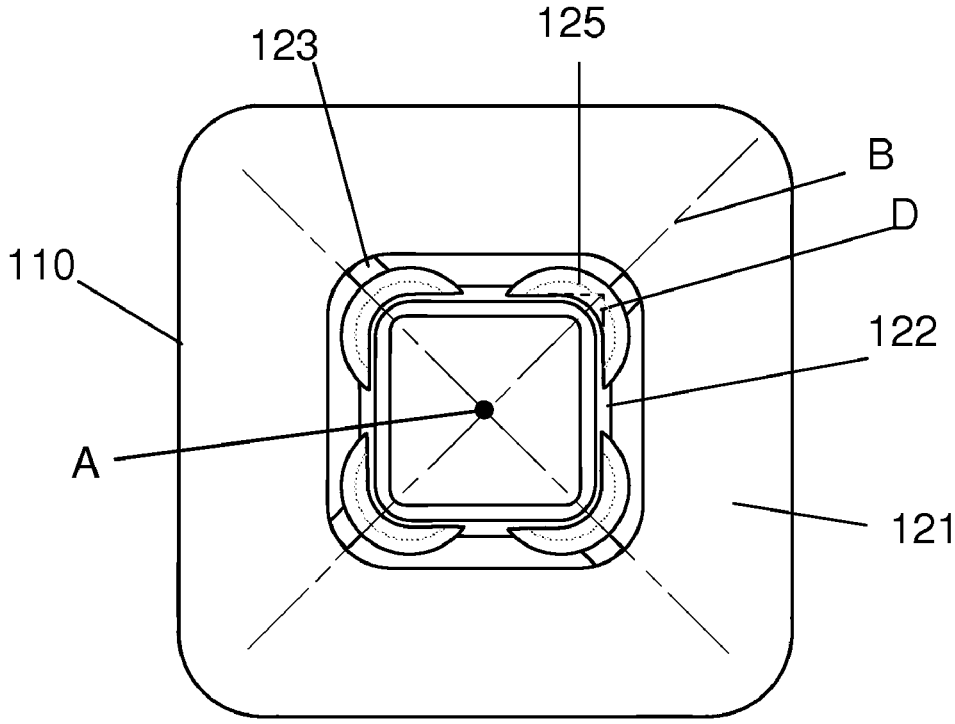
FIG. 1*b* illustrates the container head in FIG. 1*a* viewed from above.
Figure 2:
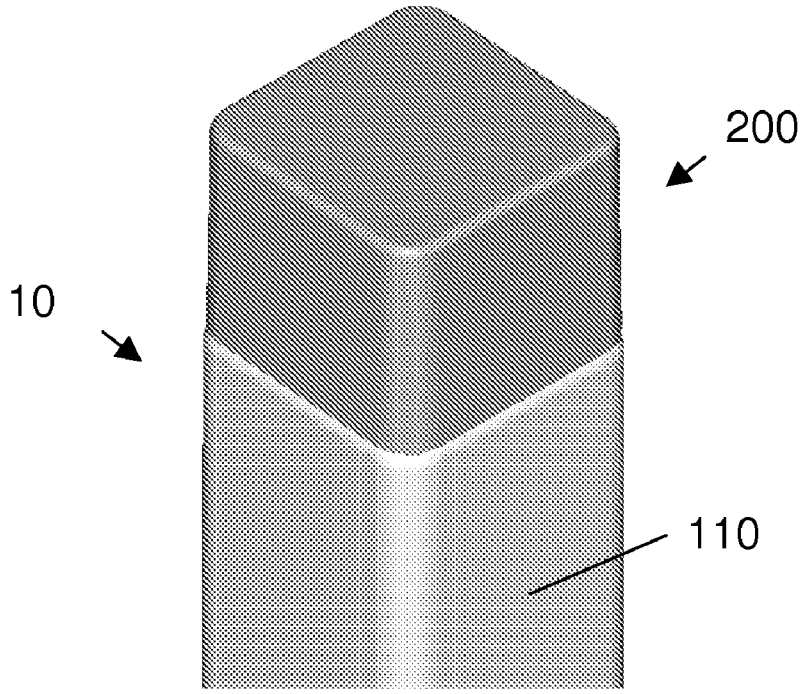
FIG. 2 illustrates, as an axonometric projection, the head of the container in FIG. 1 together with its closure.
Figure 3:
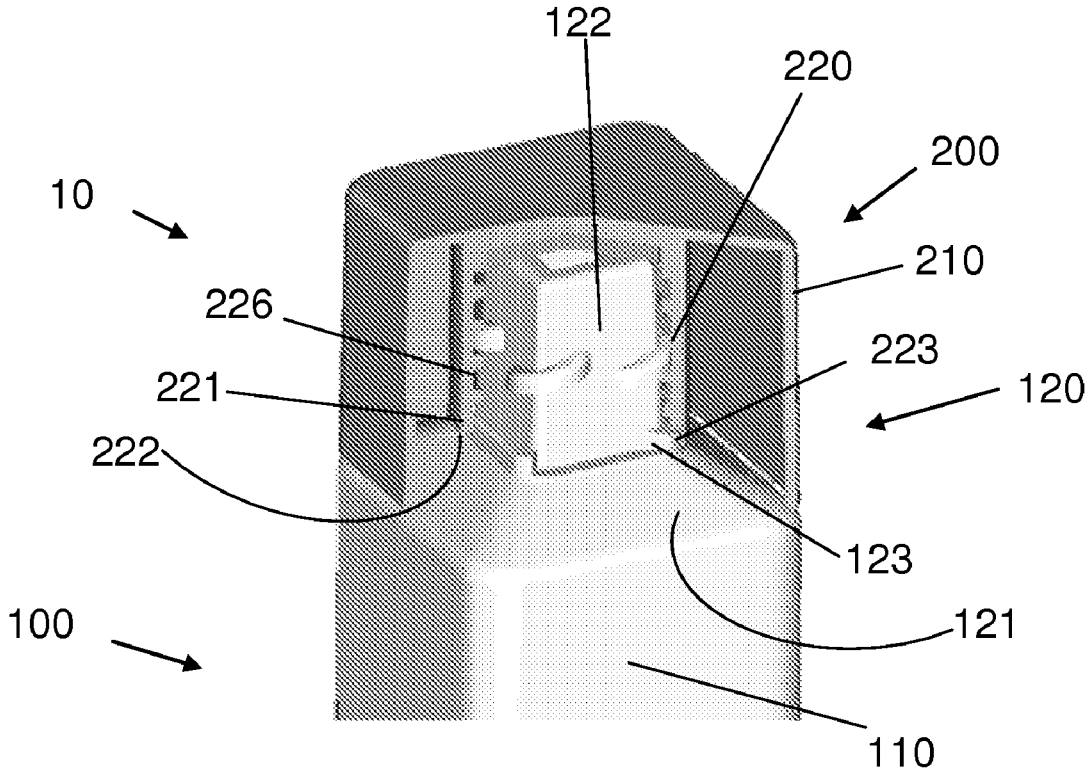
FIG. 3 illustrates the container head in FIG. 2 with its closure, as an axonometric projection and along partial cross-sections by axial half-planes forming an angle of 135° between each other.

The container in example 1 is a flexible tube, as it appears before being filled with the product that it is designed to condition. FIGS. 1*a*, 2 and 3 give a perspective view of the top end of the flexible tube 100, in its conventional spatial configuration: it is held vertically, head upwards. The flexible tube 100, provided with a closure 200 constitutes the container which, after being turned over through 180°, i.e. held vertically, upside down, will be filled by the product that it is designed to dispense. It comprises a side wall, or flexible skirt 110 and a head 120 made of plastic, with a neck 122 and a shoulder 121 connecting said neck to said flexible skirt.

The shape of the neck 122 is substantially a prism whose section is a square with angles that have been rounded by fillets. The plane faces of the prism are slightly tilted, by about 5° in relation to axis A. The wall of the neck is close to 1 mm thick. Typically, the side of the square is close to 15 mm long, the fillet radius in the angles being close to 2.5 mm.

The cap 200 is provided with a cylindrical circular fastening skirt 220, provided on its inside surface with several helical screwing grooves 226. The neck 122 is provided on its outer surface with four ribs 125. Each rib 125 extends on either side of an axial plane which is the bisecting plane B of the related dihedron D. All four ribs of the neck constitute four helical quick-screw threads (with a high slope, typically corresponding to a pitch of 4 mm per screw turn). These threads are complementary to the 4 helical screw grooves 226 worked onto the cylindrical skirt 220 of cap 200.

The ribs 125 have a small circumferential surface area, typically 7 mm on either side of the dihedron with which they are associated. They have a maximum radial height of 2 mm over a circumferential length of approximately 2 mm on either side of the bisecting plane B of said dihedron D.

The neck 122 has a 4-order symmetry around its axis A. Each rib 125 has the same slope and, around each angle, an identical maximum radial height. All 4 ribs 125 corresponding to the 4 dihedra of the neck are regularly distributed around the axis of symmetry A of the neck. Each rib 125 acts, at least in its median part where n is near the axial plane B with which it is associated and where it has a maximum radial height (or depth), as a screw thread complementary to the screw groove 226 which is associated with it.

The fastening skirt 220 is provided with 4 identical and regularly distributed quick-screw grooves 226. The 4 ribs 125 have the same slope, the same radial height, the same axial position (they are located close to the base of the neck), and they respect the 4-order symmetry around axis A. The cap can be closed in less than one quarter of a turn.

The skirt 110 itself has a globally square shape. The peripheral part 115 of shoulder 121—directly connected to the skirt—has a contour that is globally square shaped with rounded angles. The neck section is homothetic of the contour of the peripheral part 115 of shoulder 121. A geometrical configuration of this kind endows the tube with a high product restitution rate. The outer side wall 210 of cap 200 is also globally square.

The container head and the cap are provided with screw stops and anti-unscrewing devices, typically four studs 123, regularly distributed and placed at the base of the neck, in the vicinity of the axial planes, and four pairs of axial ribs worked onto the open end 221 of the fastening skirt 220. The studs 123 are placed at the base of the neck 122, at the level of the junction with the shoulder 121, which has been designed with an average thickness similar to that of the rest of the shoulder and neck so that it has a certain elastic flexibility. The open end 221 of the fastening skirt 220 is provided with four pairs of axial ribs designed to block and trap the studs 123 as the cap is screwed tight. The ribs used to block screwing are referred to as 223 in FIG. 3: they have an axial face which comes up against stud 123.

The anti-unscrewing ribs are not shown in FIG. 3 because of the half-sections chosen. For example, the rib cooperating with the stud explicitly referred to as 123 in FIG. 3 is in the part of the cap which has been removed to show the inside. By still referring to the conventional presentation of the vertically held tube, head upwards, it can be stated that each axial anti-unscrewing rib has at its summit (facing downwards) a face generated by a line perpendicular to axis A of the neck and passing through a helix of the same axis as the helix or helices of the screw threads and with a slope that is less pronounced than, but of the same sign as, said helix or helices. This face forms a helical slope in continuity with the end edge 222 (facing downwards) of the fastening skirt 220 and acts as a cam surface against which the upper surface of stud 123 presses. During screwing, the end edge 222 of the fastening skirt comes up against stud 123, and then, under the effect of said helical slope of the axial anti-unscrewing rib, is drawn downwards (with the base of the neck which has a certain elasticity) until it arrives at the top of said axial anti-unscrewing rib; the rib then quickly loses axial height and is returned to the top by elasticity, where it is trapped by the downward-moving wall of the axial anti-unscrewing rib. Said downward-moving wall has a steep slope but is not vertical in order to allow the cap to be unscrewed; this, however, requiring a certain effort from the user.

Example 2

FIGS. 4*a* to 4*e*

FIGS. 4*a* to 4*e* illustrate some examples of non-circular necks provided with screwing devices according to the invention.

Figure 4A:
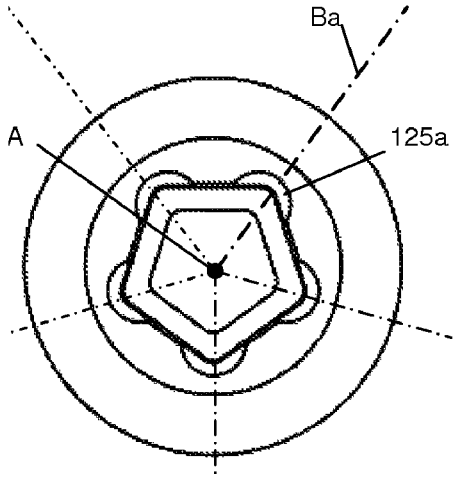
FIGS. 4*a* to 4*e* illustrate various neck shapes according to the invention, seen from above.
Figure 4B:
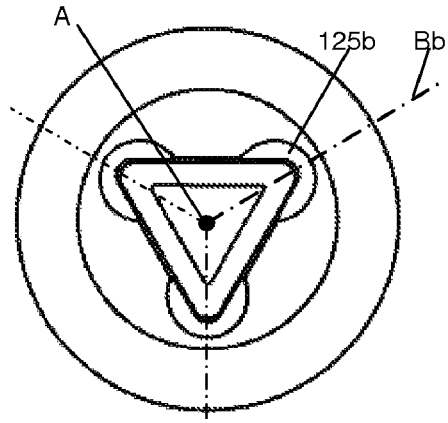

FIG. 4*a* illustrates a prismatic neck with regular pentagonal section seen from above, the tops of the pentagon being rounded by fillets. Five screwing ribs 125*a* extend on either side of the 5 axial planes Ba, which are also the bisecting planes of the 5 dihedra of the prism.

FIG. 4*a* illustrates a prismatic neck with an equilateral triangle section seen from above, the tops of the triangle being rounded by fillets. Three screwing ribs 125*b* extend on either side of the 3 axial planes Bb, which are also the bisecting planes of the 3 diedra of the prism.

Figure 4C:
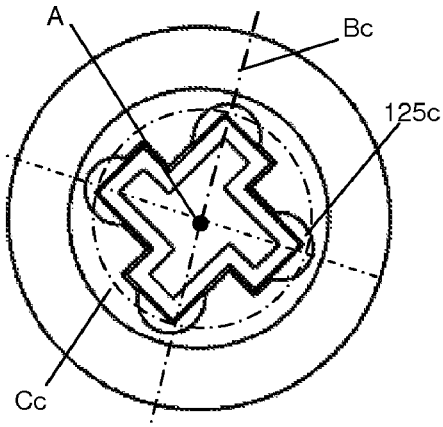

FIG. 4*c* illustrates, from above, a prismatic neck whose section has a concave shape with four branches, recalling a motif known as "hounds-tooth". The polygon has twelve summits but only four on its circumscribed diameter Cc. Four screwing ribs 125*c* extend on either side of the 4 axial planes Bc, associated with the four summits located on the circumscribed diameter (because of the even-order symmetry, these planes merge two by two).

Figure 4D:
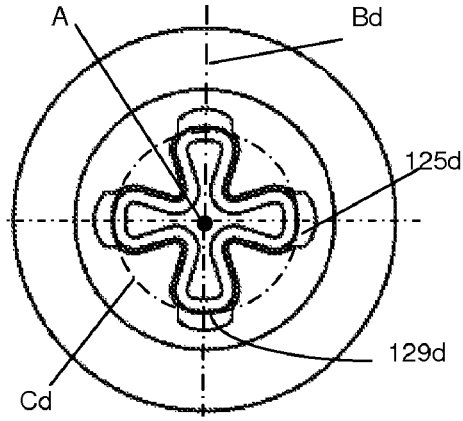

FIG. 4*d* illustrates, from above, a prismatic neck whose section has a concave shape with four branches, recalling the Saint-Andrew's cross, the facets having a certain curve and the angles being rounded by fillets. This polygon has twelve summits, of which eight are on its circumscribed diameter Cd and 4 short peripheral edges 129*d* which unite two by two said summits located on the circumscribed diameter. Four screwing ribs 125*d* extend on either side of the 4 axial planes Bd, which pass through axis A and are perpendicular to said short peripheral edges.

Figure 4E:
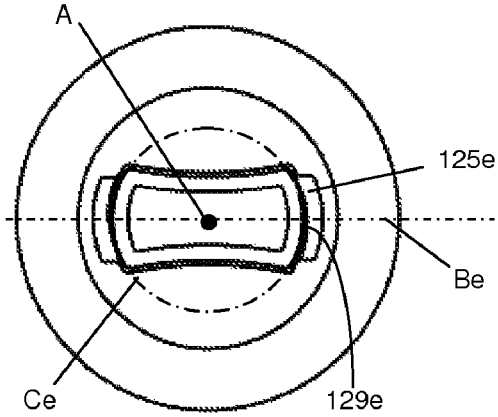

FIG. 4*e* illustrates, from above, a prismatic neck whose section has the shape of a flat bar. This polygon is a flattened rectangle, the faces corresponding to the length of the rectangle being concave, those corresponding to the width being domed; it has 4 summits on the circumscribed diameter Ce and 2 short peripheral edges 129*e* which unite said summits two by two. Four screwing ribs 125*e* extend on either side of the 2 axial planes Be (merged), which pass through axis A and are perpendicular to said short peripheral edges.

What is claimed is:

1. A container provided with a cap, said container comprising a side wall and a plastic head with a neck and a shoulder connecting said neck to said side wall, said cap being provided with a circular cylindrical skirt provided on an inner surface thereof with at least one first screwing means, the neck having a substantially prism-shaped wall having a section which is globally a polygon which has n-order symmetry around an axis A, substantially parallel with a generating line of said prism-shaped wall, n being an integer strictly greater than 1;

wherein said neck is provided on an outer surface thereof with n second screwing means regularly distributed around said axis A, all said n second screwing means on the neck cooperating with said first screwing means on the cap.

2. A container according to claim 1, wherein said n second screwing means together have n-order symmetry around said axis A.

3. A container according to claim 1, wherein said polygon has n summits on a circumscribed circle thereof, and each of said n second screwing means extend on either side of an axial plane which passes through said axis A and through one of said n summits.

4. A container according to claim 1, wherein said polygon has n peripheral summits close to a circumscribed circle thereof, and each of said n second screwing means extends on either side of an axial plane which passes through said axis A and which is perpendicular to one of said n summits.

5. A container according to claim 3, wherein said prism-shaped wall has n dihedra, and wherein said polygon is a globally convex regular polygon, said axial plane (B) being a bisecting plane of one of said n dihedra of said prism.

6. A container according to claim 3, wherein said first screwing means comprises one or more helical threads and each second screwing means is a groove having an internal part, around said axial plane, and comparable to a helical groove, all said grooves together constituting a discontinuous groove or several grooves cooperating with said threads of said cap.

7. A container according to claim 3, wherein the first screwing means comprises at least one helical groove and each second screwing means is a rib having peripheral part, around said axial plane, comparable to a helical thread, all said n ribs together constituting a discontinuous thread or several threads cooperating with said grooves of said cap.

8. A container according to claim 7, wherein the rib has a base, which is on said outer surface of said neck, extending circumferentially only slightly on either side of said axial plane, wherein the rib is of variable radial height, which is at a maximum around said axial plane (B) and which varies such that said rib has, between ends thereof and said axial planes, an average slight slope which makes it possible to limit mechanical loads generated on said thread while said cap is being screwed.

9. A container according to claim 8, wherein said base of said rib, in relation to the axis of symmetry (A) of said prism-shaped wall, has a slope identical to the slope of said at least one helical groove.

10. A container according to claim 7, wherein each said rib has a radial height substantially equal to a maximum radial height over at least one millimeter on both sides of said axial plane (B).

11. A container according to claim 7, wherein said skirt of said cap is provided with a single, p-pitched helical screwing groove, and the ribs are placed on the neck so that two consecutive ribs are axially offset by p/n, so that said n ribs constitute a discontinuous helical screwing thread cooperating with said helical screwing groove of said cap.

12. A container according to claim 7, wherein said skirt of said cap is provided with n identical and regularly distributed screwing grooves and each of said n ribs located on each of n angles of said polygon has the same axial position, enabling closure of said cap in less than one nth of a turn.

13. A container according to claim 1, wherein said head of said container and said cap are also provided with anti-unscrewing means.

14. A container according to claim 1, wherein a peripheral part of said shoulder also has a contour that is of globally polygonal shape, homothetic of said polygon of said prism-shaped wall.

15. A container according to claim 1, wherein said cap has a side wall of prismatic shape, said wall prolonging said side wall of said container, when said cap is in a closed position.

16. A container according to claim 1, wherein n is less than or equal to 7.

17. The head of a container, provided with a neck and a shoulder constructed and arranged to connect said neck to a side wall of said container, wherein a wall of said neck has substantially a shape of a prism having a section which is substantially a polygon with n-order symmetry around an axis A, substantially parallel to a generating line of said prism, n being an integer strictly greater than 1, and said neck is provided on an outer surface thereof with n second screwing means, regularly distributed around said axis A.

18. A container head according to claim 17, wherein said n second screwing means together have n-order symmetry around axis A.

19. A container head according to claim 17, wherein said polygon has n summits on a circumscribed circle of said polygon, or n short peripheral edges which are near said circumscribed circle, each of said n screwing means extending on either side of an axial plane which passes through said axis A and one of said n summits located on said circumscribed circle, or which passes through said axis A and which is perpendicular to one of said n short peripheral edges.

20. A container head claim 17, wherein n is less than or equal to 7.

* * * * *